US006237650B1

(12) United States Patent
Ansaloni

(10) Patent No.: US 6,237,650 B1
(45) Date of Patent: May 29, 2001

(54) MACHINE FOR METERING LIQUID PHARMACEUTICAL PRODUCTS

(75) Inventor: Angelo Ansaloni, Crespellano (IT)

(73) Assignee: MG2 S.p.A., Pianoro (IT)

( * ) Notice: Subject to any disclaimer, the term of this patent is extended or adjusted under 35 U.S.C. 154(b) by 0 days.

(21) Appl. No.: 09/475,059

(22) Filed: Dec. 30, 1999

(30) Foreign Application Priority Data

Jan. 5, 1999 (IT) ..... B099A0004

(51) Int. Cl.[7] ..... B65B 1/04; B65B 3/04; B65B 37/00; B67C 3/00

(52) U.S. Cl. ..... 141/237; 141/135; 141/144; 141/145; 141/147; 141/152; 141/238; 141/94; 141/95; 222/144

(58) Field of Search ..... 141/135, 137, 141/140, 144–147, 152, 83, 94, 95, 234, 238, 237; 222/144, 134

(56) References Cited

U.S. PATENT DOCUMENTS 3,580,302 * 5/1971 Riesenberg ..... 141/115
4,060,109 * 11/1977 Sotoma ..... 141/83
4,508,148 * 4/1985 Trechsel et al. ..... 141/147

* cited by examiner

*Primary Examiner*—Timothy L. Maust
(74) *Attorney, Agent, or Firm*—Finnegan, Henderson, Farabow, Garrett, & Dunner, L.L.P.

(57) ABSTRACT

The machine provides for metering liquid pharmaceutical products into bottom shells, and has: a bottom part rotating about a respective vertical axis; a number of first vertical through holes formed in the bottom part; a piston movable reciprocatingly along a respective first hole; a bottom-shell belt meshing with a portion of the bottom part; a rotary top part defined by a vessel containing the pharmaceutical product; a rotary central part coaxial and angularly integral with the bottom part and the top part; a second hole, for each first hole, formed radially along the central part; and a valve housed in each of the second holes. Two separate channels are formed in the valve; and the valve rotates between a first angular position in which a first channel hydraulically connects the inside of the vessel to a metering chamber defined along the first hole, and a second angular position in which a second channel hydraulically connects the chamber to the inside of the bottom shell.

8 Claims, 4 Drawing Sheets

65b
1
83
X
66
67
65a
65
64
65c
6
3
32
78
Y
34
8
35
76
33
4
82
77
61
81
2
22
31
14
42
12
13
5
11
16
59
21
24
23
25
60
17
18

MACHINE FOR METERING LIQUID PHARMACEUTICAL PRODUCTS

The present invention relates to a machine for metering liquid pharmaceutical products into capsules or phials.

BACKGROUND OF THE INVENTION

As is known, most currently used machines for metering liquid pharmaceutical products are what are known in the sector as "reciprocating machines", which substantially comprise a first body operating in steps and supporting a number of capsules in a spoke arrangement; a second body with internal channels and which rotates between two positions; a hopper full of liquid; and a number of hydraulic pistons. The second body, in a first position, connects the hopper hydraulically to the pistons into which a predetermined quantity of liquid is drawn, and, in a second position, connects the pistons hydraulically to respective capsules, which are arrested, for a predetermined time beneath the second body, pending injection of the liquid by the pistons into the capsules.

Machines of the above type have several drawbacks. In particular, as compared with continuously operating machines of the same overall size, reciprocating types provide for a much lower output rate per hour of capsules. What is more, at each operating step, reciprocating machines generate even severe vibration resulting not only in wear of the machine components but also in spillage of the liquid from the injected capsules, which in turn leads to other, no less serious, drawbacks, such as inaccurate filling of the capsules and fouling, or even stoppage, of the machine as a whole. Finally, on account of the cost and complications involved, reciprocating machines sometimes feature no devices for detecting the presence of capsules inside the respective seats, which, in the event of any missing capsules, results in further fouling and consequent stoppage of the machine.

To eliminate the above drawbacks of reciprocating machines, the present Applicant has devised a continuously operating machine as described in European Patent Application nr 91105443.5 filed on Apr. 5, 1991, and which comprises a rotary vessel full of liquid; a body having a number of hydraulic pistons; and a number of valves for channeling the liquid from the vessel to the pistons, and from the pistons to the capsules. The valves are slide types and are movable, along respective longitudinal axes, between a first position hydraulically connecting the vessel to the pistons, and a second position hydraulically connecting each piston to a corresponding capsule.

While undoubtedly affording advantages as compared with reciprocating machines, the above continuously operating machine also involves a number of drawbacks, especially at high speed. In particular, operation of the slide valves also results in vibration, which may even reach severe proportions at high speed, thus also resulting, albeit to a lesser degree than with reciprocating machines, in wear of the component parts of the machine, possible spillage, inaccurate filling of the capsules, and fouling of certain parts of the machine. Also, the seals on the slide valves are subject to rapid wear by the axial movement of the valves, thus resulting in all the drawbacks mentioned above relative to spillage on the outside of the machine.

SUMMARY OF THE INVENTION

It is an object of the present invention to provide a machine for metering liquid pharmaceutical products, designed to eliminate the aforementioned drawbacks.

According to the present invention, there is provided a machine for metering liquid pharmaceutical products into bottom shells, comprising:

a bottom part rotating about a respective vertical axis;

at least one first vertical through hole formed in said bottom part;

at least one piston moved in reciprocating manner along said first hole by a first device;

a bottom-shell belt meshing with a portion of said bottom part and traveling along the whole of the system of which said machine forms part;

a rotary top part having a vessel containing said pharmaceutical product;

a rotary central part coaxial and angularly integral with said bottom part and said top part;

drive means for driving said parts;

at least one second hole associated with said first hole and formed radially along said central part; and at least one valve housed in said second hole;

characterized in that a first and a separate second channel are formed in said valve; and by comprising a second device for rotating said valve, about a horizontal axis, between a first angular position in which said first channel hydraulically connects the inside of said vessel to a metering chamber defined along said first hole, and a second angular position in which said second channel hydraulically connects said chamber to the inside of said bottom shell.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
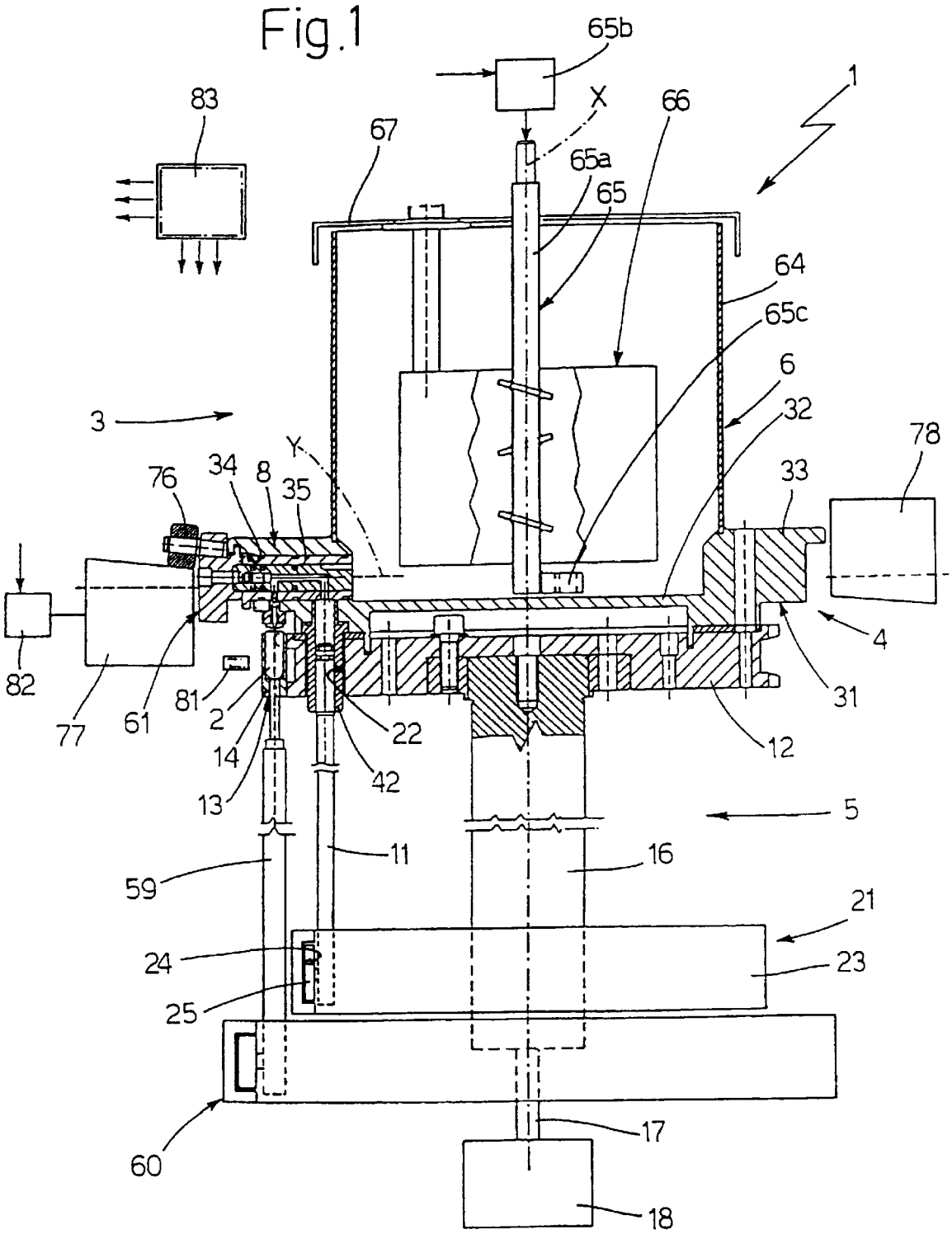
FIG. 1 shows a partly sectioned elevation of a machine in accordance with the teachings of the present invention.

Number 1 in FIG. 1 indicates as a whole a machine for metering liquid pharmaceutical products into capsules, and more specifically into bottom shells 2 of the capsules. The term "liquid products" is intended to mean liquids proper, thixotropic liquids, heat-melt liquids (inserted in the form of paste or very dense liquids) and liquids with particles in suspension. Machine 1 may be divided schematically along its vertical longitudinal axis X into three substantially cylindrical rotary parts 3, 4, 5 coaxial and angularly integral with one another. The top part, indicated 3, comprises a cylindrical vessel 6 supplied with liquid from a known copper (not shown) at the top; the central part, indicated 4, comprises a number of valves 8 which rotate, about respective horizontal longitudinal axes Y, between a first position in which a predetermined quantity of liquid is drawn from vessel 6, and a second position in which said quantity is channeled into a bottom shell 2 of a capsule; and the bottom part, indicated 5, comprises a number of hydraulic pistons 11, one for each valve 8, for providing the thrust by which to channel the liquid into bottom shell 2. Bottom part 5 also comprises a cylindrical, externally toothed portion 12 which rotates about axis X and with which meshes a belt 13 having a number of bushes 14 engaged by respective bottom shells 2.

Machine 1 normally forms part of a system comprising a number of known machines for performing various functions, such as a machine for supplying the capsules; a machine for orienting the capsules and separating the top shells from bottom shells 2; other machines for metering pharmaceutical products of various types and/or in other possible forms; a machine for closing the capsules; and a capsule packaging machine. All these machines are normally powered by the same drive means, e.g. belts, pulleys, or mesh directly with one another, have respective toothed portions similar to portion 12 and with which belt 13 meshes, and are substantially tangent to one another so that belt 13 travels along the whole system.

Bottom part 5 is rotated about axis X by a shaft 16 coaxial with axis X and connected to the output shaft 17 of a motor 18 in known manner, as stated, on machines of this sort and therefore shown only schematically. Portion 12 is in the form of a rotary drum having, along an intermediate ring, a number of equally spaced vertical through holes 22, along each of which a respective piston 11, associated with each valve 8, slides in reciprocating manner. Machine 1 also comprises a device 21 for controlling translation of pistons 11, and which comprises a fixed cylindrical cam 23 in which is formed an annular track 24 engaged by a wheel 25 carried by a bottom end portion of each piston 11. The above translation control system is only shown schematically, by being known and also used on other machines of this sort, though normally for translating pins performing different functions from those of pistons 11.

Figure 2:
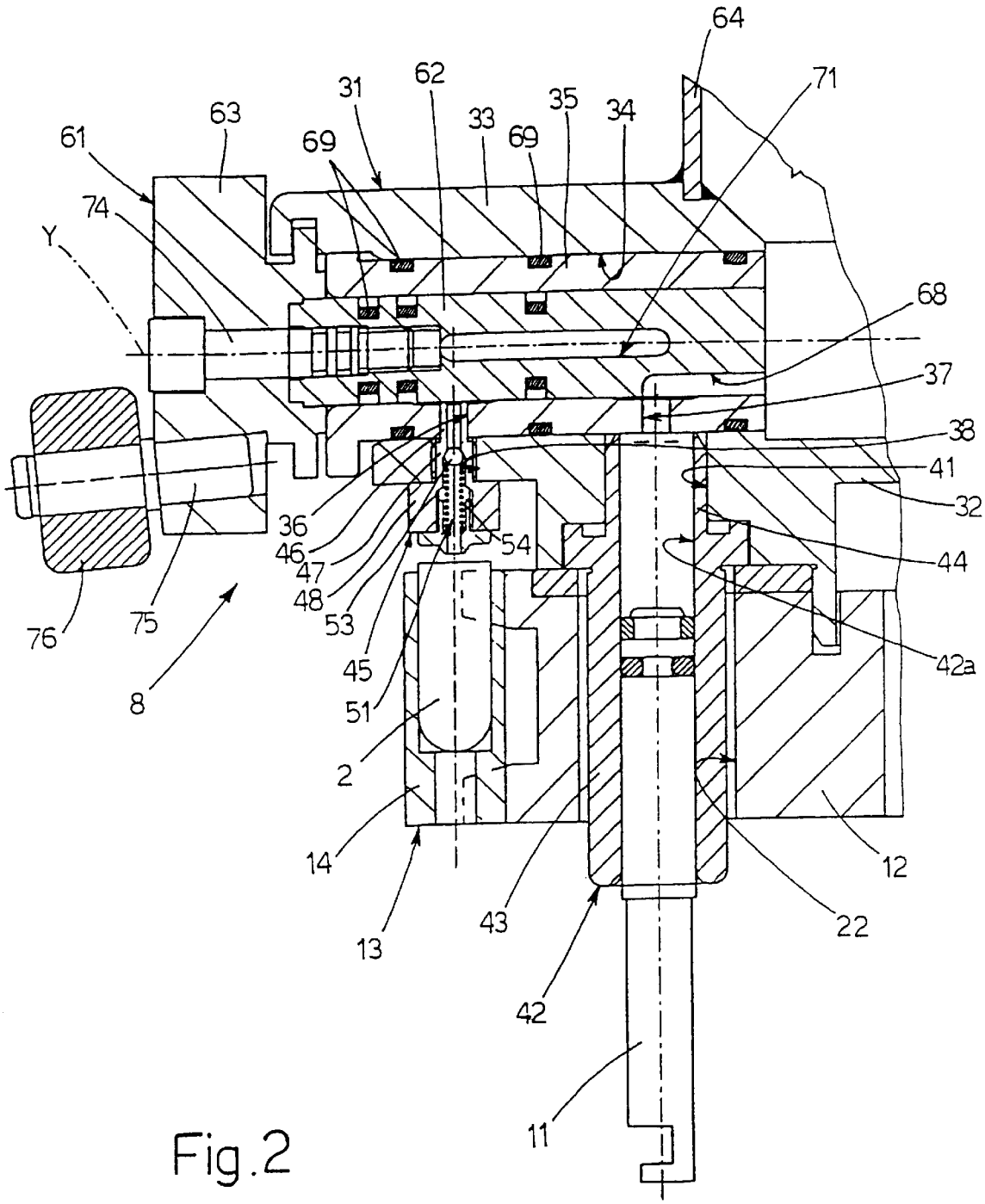
FIGS. 2 and 3 show larger-scale sections of part of the FIG. 1 machine in two different operating positions.
Figure 3:
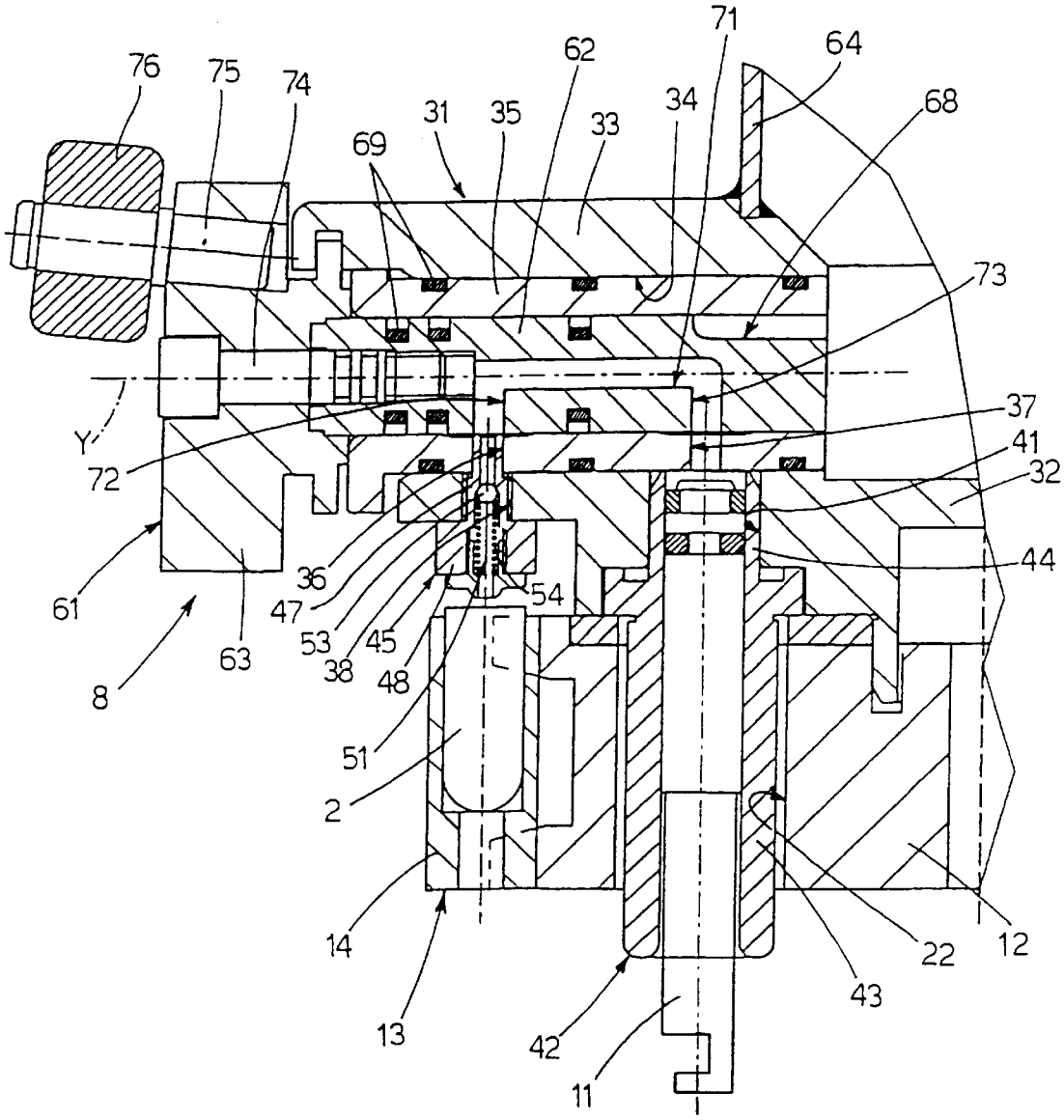
Figure 4:
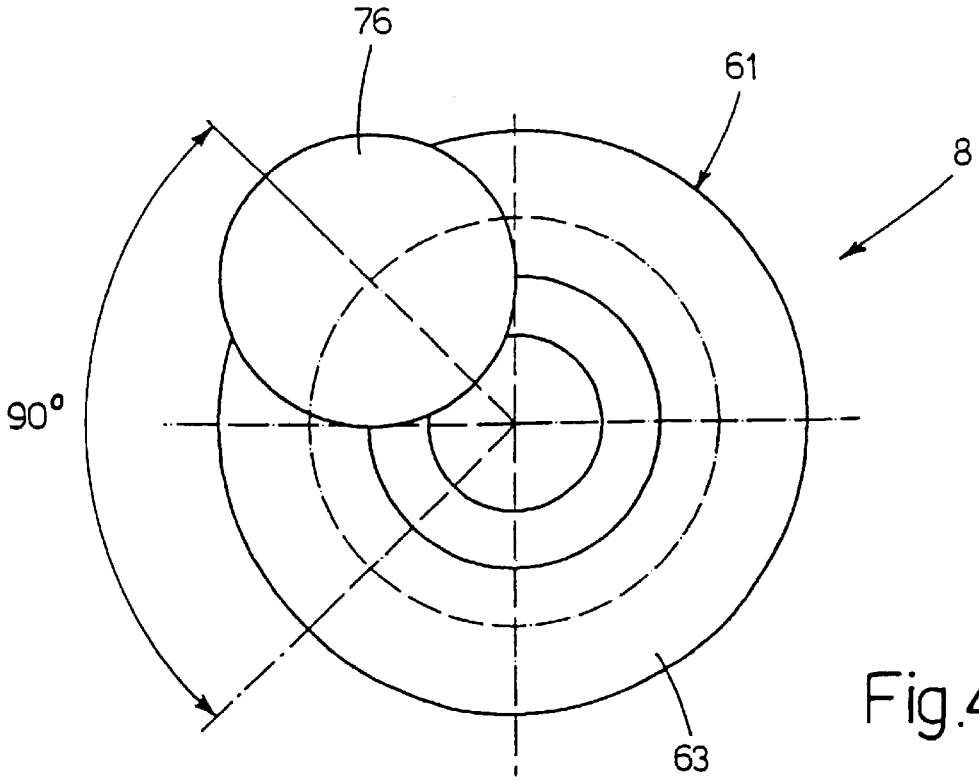
FIGS. 4 and 5 show front views of a component of the FIG. 1 machine in two different operating positions.

With reference to FIGS. 1, 2 and 3, central part 4 comprises a cup-shaped body 31 carried by portion 12 and in turn comprising a circular bottom wall 32 and an annular lateral wall 33 extending upwards from the peripheral edge of wall 32. Wall 33 is low in height, is decidedly thicker than wall 32, and has a number of equally spaced radial through holes 34, each housing a corresponding valve 8. Each hole 34 also houses a cylindrical sleeve 35 integral with wall 33; the end, inside machine 1, of sleeve 35 is substantially flush with the end, inside machine 1, of hole 34; sleeve 35 has two vertical through holes 36, 37, each for connecting the inside of hole 34 to a respective vertical through hole 38, 41 formed close to the rim of bottom wall 32; hole 38 is coaxial with bottom shell 2 underneath; and hole 41 is coaxial with a corresponding hole 22 underneath.

With reference to FIGS. 2 and 3, machine 1 comprises, for each piston 11, a cylindrical bush 42 inside which piston 11 translates, and which comprises a bottom portion. 43 housed inside hole 22, and a top portion 44 housed inside hole 41. Machine 1 also comprises, for each hole 38, a further bush 45 in turn comprising a top portion 46 housed inside hole 36, a central portion 47 housed inside hole 38, and a bottom portion 48 outside hole 38 and beneath wall 32. Each bush 45 is fitted inside with an on-off valve 51 comprising a ball 53, and a spring 54 for pushing ball 53 upwards and against a shoulder formed along the inner hole of bush 45. In actual use, when a predetermined quantity of liquid is fed on top of ball 53, the pressure of the liquid overcomes the pressure exerted by spring 54 and so pushes ball 53 down to allow the liquid to flow into bottom shell 2 underneath. When there is no liquid on top of ball 53, or the weight of the liquid is insufficient to overcome the action of spring 54, ball 53 closes the liquid passage along bush 45. On-off valve 51 thus eliminates any drips caused by any leftover liquid on top of valve 51 itself.

With reference to FIG. 1, each bush 14 is associated with a vertical pin 59 movable axially, by means of a device 60 similar to device 21, between a first position in which the top tip of pin 59 is outside bush 14, and a second position, assumed when metering the liquid into bottom shell 2, in which the top tip of pin 59 penetrates bush 14 to move bottom shell 2 up to bush 45.

With reference to FIGS. 2 and 3, each valve 8 comprises a substantially cylindrical valve body 61 having and free to rotate about a longitudinal axis Y, and in turn comprising a portion 62 housed inside sleeve 35, and a portion 63 outside sleeve 35 and hole 34. Annular seals 69 are fitted between sleeve 35 and the inside of hole 34, and between portion 62 and the inside of sleeve 35; the end, inside machine 1, of portion 62 is substantially flush with the end, inside machine 1, of sleeve 35; and portion 62 comprises a first channel, which, in a first angular position of valve 8, hydraulically connects the inside of vessel 6 to the inside of bush 42, and a second channel, separate from the first, which, in a second angular position of valve 8, hydraulically connects the inside of bush 42 to the inside of bush 45.

With reference to FIG. 1, vessel 6 is defined at the bottom by the upper face of wall 32, and laterally by the inner face of wall 33 and by the inner face of a tall, thin, hollow cylinder 64 integral with wall 33 and extending upwards, coaxially with axis X, from the upper face of wall 33. Vessel 6 is fitted inside with a known mixing device 65 and a known heat exchanger 66; cylinder 64 is closed at the top by a fixed cover 67 supporting devices 65 and 66; and device 65 comprises a rotary shaft 65*a* of axis X, drive means 65*b* for driving shaft 65*a*, and an appendix 65*c* extending from the bottom end portion of shaft 65*a* and for mixing the liquid inside vessel 6.

With reference to FIGS. 2 and 3, the first channel of portion 62 is defined by a slot 68 formed, along a horizontal axis parallel to axis Y, on the outer face of portion 62, at the end of portion 62 inside machine 1, and which is of such a length as to face hole 37 in a given angular position of portion 62. That is, in said given angular position of portion 62, slot 68 hydraulically connects the inside of vessel 6 to the inside of hole 37 and, via hole 37 and hole 41, to the inside of bush 42.

With reference to FIG. 3, the second channel is defined by a dead hole 71 formed along axis Y, and by two holes 72 and 73 extending radially from hole 71; the axis of hole 72 lies in the same plane as the axis of hole 36; the axis of hole 73 lies in the same plane as the axis of hole 37; hole 71 extends from portion 63 up to a portion of portion 62 corresponding to the inner end of slot 68; at portion 63 and an adjacent portion of portion 62, hole 71 is closed by a plug 74, so that the second channel is longitudinally U-shaped; and, in a given angular position of portion 62, the second channel hydraulically connects holes 37 and 36 to each other, and therefore the inside of bush 42 to the inside of bush 45.

With reference to FIGS. 2, 3, 4 and 5, portion 63 of valve body 61 supports a pin 75 extending from the vertical face, outside machine 1, of portion 63, and fitted with an idle wheel 76. Machine 1 (FIG. 1) comprises two fixed cams 77 and 78, which cooperate with wheel 76 to rotate valve body 61, about respective axis Y, between a first position permitting withdrawal from vessel 6 of a predetermined quantity of liquid stored inside bush 42, and a second position enabling said quantity to be channeled into a bottom shell 2 of a capsule, and vice versa. Cams 77 and 78 are defined by respective wedges fitted outside machine 1 at a given angular distance from each other; and the wedges have respective faces on which wheel 76 rests, and which extend in an oblique plane with respect to the horizontal plane of axes Y of valves 8.

Figure 5:
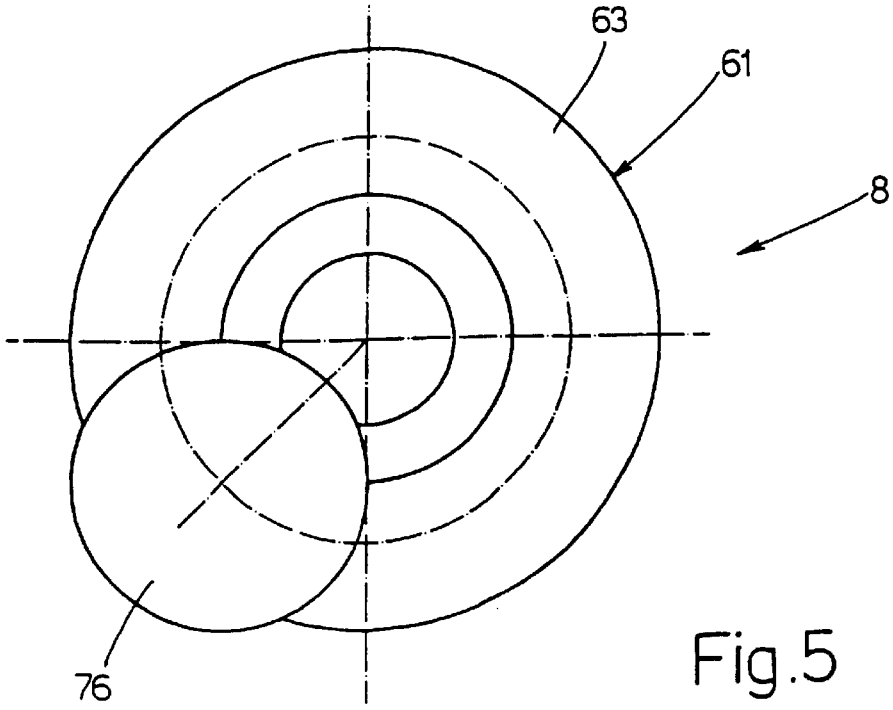

More specifically, as of the angular position of valve 8 shown in FIGS. 2 and 5, wheel 76, as parts 3, 4 and 5 rotate, comes into contact with cam 77 so as to rotate valve 8 (90° in the embodiment shown) from said first angular position to said second angular position. When wheel 76 is detached from cam 77, valve 8 remains in said second position until wheel 76—again, as parts 3, 4 and 5 rotate—comes into contact with cam 78 so as to rotate valve 8 (again by 90° ) from said second angular position to said first angular position.

With reference to FIG. 1, machine 1 also comprises a sensor 81 for detecting the presence of bottom shells 2 inside respective bushes 14 on belt 13; and means 82 for moving cam 77 between a work position, in which, for each turn of rotary parts 3, 4 and 5, cam 77 comes into contact with wheels 76 of valves 8, and an extracted position in which cam 77 is moved clear of and not contacted by wheel 76. The operation of machine 1 is controlled by an electronic central control unit 83.

In actual use, for each turn of rotary parts 3, 4 and 5, wheel 76 comes into contact with cam 78 to rotate portion 62 of valve 8 into such an angular position as to hydraulically connect vessel 6 to the inside of bush 42 for a predetermined length of time, and to close the top part of bush 45 for the same length of time. At this operating stage, piston 11 is moved down by cam 23 to form, inside the top part of bush 42, a metering chamber 42*a* (FIG. 2) which is filled with liquid from vessel 6; and, at the next stage, piston 11 is raised slightly to expel into vessel 6 any air inside the liquid filling chamber 42*a*.

At the final stage, wheel 76 comes into contact with cam 77 to rotate portion 6.2 of valve 8 into such an angular position as to hydraulically connect chamber 42*a* to bush 45 for a predetermined length of time, and to hydraulically disconnect vessel 6 and chamber 42*a* for the same length of time. At this stage, a bottom shell 2 is positioned coaxially beneath bush 45, ready to receive a predetermined quantity of liquid, and the corresponding piston 11 is raised to expel the liquid from chamber 42*a*; which liquid, via the second channel formed in portion 62, is forced into bush 45 and from bush 45 into bottom shell 2, by the pressure exerted by piston 11 overcoming the action of spring 54 and so freeing the flow passage along bush 45. The quantity of liquid fed into bottom shell 2 is directly proportional to the travel of piston 11 and, hence, to the volume of chamber 42*a*. Obviously, not all the liquid fed into valve 8 drops into bottom shell 2, since, there being no thrust or pressure on the liquid at the end of the up-stroke of piston 11, part of the liquid remains inside the second channel, also during the next rotation of valve 8, so that, at each turn, piston 11 only actually draws the quantity to fill chamber 42*a* and which is subsequently fed into bottom shell 2.

Central control unit 83 controls operation of machine 1, and in particular device 66, to determine the temperature of the liquid inside vessel 6, especially in the case of products such as heat-melt liquids for which, as is known, a predetermined temperature must be maintained during the metering operation. Central control unit 83 also controls device 65, which provides for homogenizing the product (as in the case of liquids with particles in suspension) and for achieving uniform temperature. When a missing bottom shell 2 is detected, central control unit 83, as stated, moves cam 77 from the work to the extracted position, so that wheel 76 of the valve 8 corresponding to the missing bottom shell 2 clears cam 77, and valve 8 remains in the first angular position hydraulically connecting vessel 6 and chamber 42*a*. This therefore prevents leakage, by the second channel being closed, while at the same times seeing as respective piston 11 still performs the up-stroke, enabling the liquid to be fed back into vessel 6.

The advantages of the present invention will be clear from the foregoing description.

In particular, it provides for a continuously operating machine permitting a high output rate per hour and a considerable reduction in vibration and, hence, in wear of machine components. Reducing vibration also prevents spillage on machine 1 and ensures precise metering of the liquid into bottom shell 2. It should be stressed that vibration is also reduced by the type of movement (rotary) of valves 8; which movement permits the use of annular seals 69, which, as is known, perform better and have a longer working life when fitted to cylindrical rotary elements. Moreover, machine 1 comprises a series of devices (valve 51, pins 59, sensor 81) preventing spillage from bottom shell 2. In short, machine 1 according to the teachings of the present invention provides for a high degree of reliability.

Clearly, changes may be made to machine 1 as described and illustrated herein without, however, departing from the scope of the present invention.

What is claimed is:

1. A machine for metering liquid pharmaceutical products into bottom shells (2), comprising:

a bottom part (5) rotating about a respective vertical axis (X);

at least one first vertical through hole (22) formed in said bottom part (5);

at least one piston (11) moved in reciprocating manner along said first hole (22) by a first device (21);

a bottom-shell (2) belt (13) meshing with a portion (12) of said bottom part (5) and traveling along the whole of the system of which said machine forms part;

a rotary top part (3) having a vessel (6) containing said pharmaceutical product;

a rotary central part (4) coaxial and angularly integral with said bottom part (5) and said top part (3);

drive means (18) for driving said parts (3, 4, 5);

at least one second hole (34) associated with said first hole (22) and formed radially along said central part (4);

at least one valve (8) housed in said second hole (34);

a first and a separate second channel are formed in said valve (8);

a second device (77, 78) for rotating said valve (8), about a horizontal axis (Y), between a first angular position in which said first channel hydraulically connects the inside of said vessel (6) to a metering chamber (42*a*) defined along said first hole (22), and a second angular position in which said second channel is adapted to hydraulically connect said chamber (42*a*) to the inside of said bottom, shell (2); and wherein, between said second channel and said bottom shell (2), there is fitted an on-off valve (51) which permits passage of the liquid when a quantity of liquid of a pressure greater than a predetermined value is fed over said on-off valve (51), so as to prevent dripping of the leftover liquid on top of said on-off valve (51).

2. A machine as claimed in claim 1, characterized in that a third (41) and a fourth (38) hole are formed in said central part (4), at each said second hole (34); said third hole (41) being coaxial with and over said chamber (42*a*); said fourth hole (38) being coaxial with and over said bottom shell (2); said first channel, with said valve (8) in said first angular position, hydraulically connecting said vessel (6) and said chamber (42*a*) via said third hole (41); and said second channel, with said valve (8) in said second angular position, communicating hydraulically with said chamber (42*a*) via said third hole (41), and with said bottom shell (2) via said fourth hole (38).

3. A machine as claimed in claim 2, characterized in that said valve (8) comprises a substantially cylindrical valve body (61) defined longitudinally along said horizontal axis (Y) and free to rotate about said horizontal axis (Y); said valve body (61) having a first portion (62) housed inside said second hole (34), and a second portion (63) outside said second hole (34); and said channels being formed in said first portion (62).

4. A machine as claimed in claim 3, characterized in that said first channel is defined by a slot (68) formed, along an axis parallel to said horizontal axis (Y), on the outer face of said first portion (62), at the end of the first portion facing said vessel (6); said slot (68) being of such a length as to face said third hole (41) in said first angular position of said valve (8).

5. A machine as claimed in claim 4, characterized in that said second channel is U-shaped and defined by a dead hole (71) formed along said horizontal axis (Y), and by a fifth and a sixth hole (72, 73) extending radially from said dead hole (71); with said valve (8) in said second angular position, said fifth hole (72) being coaxial with said fourth hole (38), and said sixth hole (73) being coaxial with said third hole (41).

6. A machine as claimed in claim 3, characterized in that said second portion (63) of said valve body (61) supports an appendix (76); and in that said second device comprises two cams (77, 78) which cooperate with said appendix (76) to rotate said valve body (61), about said horizontal axis (Y), between said angular positions.

7. A machine as claimed in claim 1, characterized by comprising a vertical pin (59) movable axially, by means of a third device (60), between a first position in which the top tip of said pin (59) is clear of said bottom shell (2), and a second position, assumed when metering the liquid into said bottom shell. (2), in which the top tip of said pin (59) moves said bottom shell (2) up to said valve (8).

8. A machine as claimed in claim 1, characterized by comprising a sensor (81) for detecting the presence of said bottom shell (2) along said belt (13); and means for preventing rotation of said valve (8) from said first to said second angular position in the event said bottom shell (2) is missing along said belt.

* * * * *